US008646275B2

(12) United States Patent
Rackwitz et al.

(10) Patent No.: US 8,646,275 B2
(45) Date of Patent: Feb. 11, 2014

(54) GAS-TURBINE LEAN COMBUSTOR WITH FUEL NOZZLE WITH CONTROLLED FUEL INHOMOGENEITY

(75) Inventors: Leif Rackwitz, Rangsdorf (DE); Imon-Kalyan Bagchi, Berlin (DE); Thomas Doerr, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 13/415,173

(22) Filed: Mar. 8, 2012

(65) Prior Publication Data

US 2012/0174588 A1 Jul. 12, 2012

Related U.S. Application Data

(62) Division of application No. 12/232,324, filed on Sep. 15, 2008, now abandoned.

(30) Foreign Application Priority Data

Sep. 13, 2007 (DE) ..... 10 2007 043 626

(51) Int. Cl.
*F02C 1/00* (2006.01)

(52) U.S. Cl.
USPC ..... 60/749; 60/737; 60/740; 60/746

(58) Field of Classification Search
USPC ..... 60/737, 740, 743, 746, 748, 749
See application file for complete search history.

(56) References Cited

U.S. PATENT DOCUMENTS

| | | | |
|---|---|---|---|
| 3,091,283 | A | 5/1963 | Kidwell |
| 3,568,650 | A | 3/1971 | Albrich |
| 3,608,831 | A | 9/1971 | Place et al. |
| 3,699,773 | A | 10/1972 | Schuning |
| 3,703,259 | A | 11/1972 | Sturgess et al. |
| 3,713,588 | A | 1/1973 | Sharpe |
| 3,808,803 | A | 5/1974 | Salvi |
| 3,866,413 | A | 2/1975 | Sturgess |
| 3,919,840 | A | 11/1975 | Markowski |
| 3,930,369 | A | 1/1976 | Verdouw |
| 3,937,011 | A | 2/1976 | Caruel |
| 3,955,361 | A | 5/1976 | Schirmer |

(Continued)

FOREIGN PATENT DOCUMENTS

| | | |
|---|---|---|
| DE | 26 18 219 | 11/1976 |
| DE | 38 39 542 | 8/1989 |

(Continued)

OTHER PUBLICATIONS

German Search Report dated Jan. 15, 2009.

(Continued)

*Primary Examiner* — Ehud Gartenberg
*Assistant Examiner* — Arun Goyal
(74) *Attorney, Agent, or Firm* — Timothy J. Klima; Shuttleworth & Ingersoll, PLC

(57) ABSTRACT

A gas-turbine lean combustor includes a combustion chamber (2) and a fuel nozzle (1) which includes a pilot fuel injection (17) and a main fuel injection (18). The main fuel injection (18) includes central recesses (23) for a controlled inhomogeneous fuel injection, the number of said recesses on the circumference ranging from 8 to 40 and said recesses having an angle of inclination δ2 in circumferential direction of $10° \leq \delta 2 \leq 60°$ and an axial angle of inclination δ1 relative to the combustor axis (4) between $-10° \leq \delta 1 \leq 90°$.

18 Claims, 16 Drawing Sheets

(56) References Cited

U.S. PATENT DOCUMENTS

| | | | |
|---|---|---|---|
| 3,977,186 | A | 8/1976 | Arvin et al. |
| 3,980,233 | A | 9/1976 | Simmons et al. |
| 4,099,505 | A | 7/1978 | Stumpp et al. |
| 4,141,213 | A | 2/1979 | Ross |
| 4,170,108 | A | 10/1979 | Mobsby |
| 4,175,380 | A | 11/1979 | Baycura |
| 4,218,020 | A | 8/1980 | Reider |
| 4,222,243 | A | 9/1980 | Mobsby |
| 4,237,694 | A | 12/1980 | Wood et al. |
| 4,425,755 | A | 1/1984 | Hughes |
| 4,445,339 | A | 5/1984 | Davis, Jr. et al. |
| 4,519,958 | A | 5/1985 | Kendig |
| 4,845,952 | A | 7/1989 | Beebe |
| 4,854,127 | A | 8/1989 | Vinson et al. |
| 4,920,740 | A | 5/1990 | Shekleton |
| 4,974,416 | A | 12/1990 | Taylor |
| 5,154,059 | A | 10/1992 | Keller |
| 5,165,241 | A | 11/1992 | Joshi et al. |
| 5,251,447 | A | 10/1993 | Joshi |
| 5,303,554 | A | 4/1994 | Faulkner |
| 5,351,475 | A | 10/1994 | Ansart |
| 5,351,477 | A | 10/1994 | Joshi et al. |
| 5,373,693 | A | 12/1994 | Zarzalis |
| 5,375,995 | A | 12/1994 | Dobbeling et al. |
| 5,479,781 | A | 1/1996 | Fric et al. |
| 5,505,045 | A | 4/1996 | Lee |
| 5,511,375 | A | 4/1996 | Joshi et al. |
| 5,515,680 | A | 5/1996 | Fujimura et al. |
| 5,590,529 | A | 1/1997 | Joshi et al. |
| 5,609,030 | A | 3/1997 | Althaus |
| 5,647,215 | A | 7/1997 | Sharifi et al. |
| 5,673,551 | A | 10/1997 | Dobbeling |
| 5,735,117 | A | 4/1998 | Toelle |
| 5,778,676 | A | 7/1998 | Joshi |
| 5,799,872 | A | 9/1998 | Nesbitt et al. |
| 5,816,049 | A | 10/1998 | Joshi |
| 5,822,992 | A | 10/1998 | Dean |
| 5,881,550 | A | 3/1999 | Toelle |
| 5,916,142 | A | 6/1999 | Snyder et al. |
| 5,927,076 | A | 7/1999 | Pillsbury |
| 5,937,653 | A | 8/1999 | Alary et al. |
| 5,966,937 | A | 10/1999 | Graves |
| 5,983,642 | A | 11/1999 | Parker et al. |
| 6,045,351 | A | 4/2000 | Dobbeling et al. |
| 6,067,790 | A | 5/2000 | Choi et al. |
| 6,070,411 | A | 6/2000 | Iwai et al. |
| 6,094,916 | A | 8/2000 | Puri |
| 6,119,459 | A | 9/2000 | Gomez |
| 6,122,916 | A | 9/2000 | Amos et al. |
| 6,141,967 | A | 11/2000 | Angel et al. |
| 6,152,726 | A | 11/2000 | Ruck |
| 6,158,223 | A | 12/2000 | Mandai et al. |
| 6,216,466 | B1 | 4/2001 | Alkabie |
| 6,238,206 | B1 | 5/2001 | Cummings et al. |
| 6,256,975 | B1 | 7/2001 | Dobbeling et al. |
| 6,272,640 | B1 | 8/2001 | Sokol |
| 6,272,840 | B1 | 8/2001 | Crocker et al. |
| 6,289,676 | B1 | 9/2001 | Prociw |
| 6,289,677 | B1 | 9/2001 | Prociw |
| 6,301,899 | B1 | 10/2001 | Dean et al. |
| 6,334,309 | B1 | 1/2002 | Dean et al. |
| 6,360,525 | B1 | 3/2002 | Senior et al. |
| 6,363,725 | B1 | 4/2002 | Mei et al. |
| 6,367,262 | B1 | 4/2002 | Mongia et al. |
| 6,418,726 | B1 | 7/2002 | Foust et al. |
| 6,453,660 | B1 | 9/2002 | Johnson et al. |
| 6,460,345 | B1 | 10/2002 | Beebe et al. |
| 6,474,569 | B1 | 11/2002 | Brundish |
| 6,481,209 | B1 | 11/2002 | Johnson et al. |
| 6,532,726 | B2 | 3/2003 | Norster et al. |
| 6,536,412 | B2 | 3/2003 | Someno et al. |
| 6,543,235 | B1 | 4/2003 | Crocker et al. |
| 6,634,175 | B1 | 10/2003 | Kawata et al. |
| 6,655,145 | B2 | 12/2003 | Boardman |
| 6,675,581 | B1 | 1/2004 | Stuttaford et al. |
| 6,675,583 | B2 | 1/2004 | Willis et al. |
| 6,688,109 | B2 | 2/2004 | Hein |
| 6,691,516 | B2 | 2/2004 | Stuttaford et al. |
| 6,705,087 | B1 | 3/2004 | Ohri et al. |
| 6,722,132 | B2 | 4/2004 | Stuttaford et al. |
| 6,735,949 | B1 | 5/2004 | Haynes et al. |
| 6,799,427 | B2 | 10/2004 | Calvez |
| 6,820,411 | B2 | 11/2004 | Pederson et al. |
| 6,968,255 | B1 | 11/2005 | Dimaridis et al. |
| 6,986,255 | B2 | 1/2006 | Smith et al. |
| 6,993,916 | B2 | 2/2006 | Johnson et al. |
| 7,047,746 | B2 | 5/2006 | Hellat |
| 7,065,972 | B2 | 6/2006 | Zupanc et al. |
| 7,086,234 | B2 | 8/2006 | Doerr et al. |
| 7,546,734 | B2 | 6/2009 | Dorr et al. |
| 7,547,654 | B2 | 6/2009 | Boisson et al. |
| 7,658,075 | B2 | 2/2010 | Von Der Bank |
| 7,694,521 | B2 | 4/2010 | Ohta et al. |
| 7,779,636 | B2 | 8/2010 | Buelow et al. |
| 2001/0023590 | A1 | 9/2001 | Mandai et al. |
| 2002/0011064 | A1 | 1/2002 | Crocker et al. |
| 2002/0014078 | A1 | 2/2002 | Mandai et al. |
| 2002/0139121 | A1 | 10/2002 | Cornwell et al. |
| 2002/0162333 | A1 | 11/2002 | Zelina |
| 2002/0174656 | A1 | 11/2002 | Hein |
| 2003/0093997 | A1 | 5/2003 | Stalder |
| 2004/0003596 | A1 | 1/2004 | Chin |
| 2004/0040311 | A1 | 3/2004 | Doerr et al. |
| 2004/0055270 | A1 | 3/2004 | Blomeyer |
| 2004/0055308 | A1 | 3/2004 | Blomeyer |
| 2004/0195402 | A1 | 10/2004 | Joshi |
| 2005/0028526 | A1 | 2/2005 | Von Der Bank |
| 2005/0039456 | A1 | 2/2005 | Hayashi |
| 2005/0050895 | A1 | 3/2005 | Dorr et al. |
| 2005/0097889 | A1 | 5/2005 | Pilatis et al. |
| 2005/0115244 | A1 | 6/2005 | Griffin et al. |
| 2006/0248898 | A1 | 11/2006 | Buelow et al. |
| 2007/0042307 | A1 | 2/2007 | DeMarcos et al. |

FOREIGN PATENT DOCUMENTS

| | | |
|---|---|---|
| DE | 3819898 | 12/1989 |
| DE | 3913124 | 12/1989 |
| DE | 42 03 775 | 8/1993 |
| DE | 4316474 | 11/1994 |
| DE | 19533055 | 3/1996 |
| DE | 19527453 | 1/1997 |
| DE | 19532264 | 3/1997 |
| DE | 19535370 | 3/1997 |
| DE | 19757189 | 6/1999 |
| DE | 697 22 517 | 4/2004 |
| DE | 699 11 008 | 4/2004 |
| DE | 103 40 826 | 3/2005 |
| DE | 699 27 025 | 6/2006 |
| DE | 10 2005 062079 | 7/2007 |
| DE | 102007015311 | 10/2007 |
| EP | 0500256 | 8/1992 |
| EP | 0561591 | 9/1993 |
| EP | 0724115 | 7/1996 |
| EP | 0751345 | 1/1997 |
| EP | 0870989 | 10/1998 |
| EP | 0994300 | 4/2000 |
| EP | 1172610 | 1/2002 |
| EP | 1445540 | 8/2004 |
| EP | 17 14 081 | 10/2006 |
| GB | 1420027 | 1/1976 |
| GB | 1537671 | 1/1979 |
| GB | 2012415 | 7/1979 |
| WO | 98/55800 | 12/1998 |
| WO | 99/06767 | 2/1999 |
| WO | 9954610 | 10/1999 |
| WO | 02/095293 | 11/2002 |
| WO | 2005028526 | 3/2005 |

OTHER PUBLICATIONS

German Search Report dated May 16, 2008.

European Search Report dated Aug. 24, 2012 from counterpart application.

GAS-TURBINE LEAN COMBUSTOR WITH FUEL NOZZLE WITH CONTROLLED FUEL INHOMOGENEITY

This application is a divisional of U.S. patent application Ser. No. 12/232,324 filed Sep. 15, 2008, which claims priority to German Patent Application DE102007043626.4 filed Sep. 13, 2007, and the entirety of both applications are incorporated by reference herein.

The present invention relates to a gas-turbine lean combustor. In detail, the present invention relates to a fuel nozzle of controlled fuel inhomogeneity, which offers the possibility of introducing fuel in a way that is optimal for combustion.

Different concepts for fuel nozzles are known for reducing thermally generated nitrogen oxide emissions. One possibility uses operating combustors with a high air/fuel excess. Here, use is made of the principle that due to a lean mixture, and while ensuring an adequate spatial homogeneity of the fuel/air mixture at the same time, a reduction of the combustion temperatures and thus of the thermally generated nitrogen oxides is made possible. Moreover, in many combustors of such type, a so-called internal fuel staging system is employed. This means that, apart from a main fuel injection designed for low NOx emissions, a so-called pilot stage is integrated into the combustor, the pilot stage being operated with an increased fuel/air amount and designed to ensure combustion stability, adequate combustion chamber burn-out and appropriate ignition characteristics (see FIG. 1). The main stage of the known so-called lean combustor is often configured as a so-called film applicator (US 2006/0248898 A1). Apart from the film applicator variants, a few injection methods with single jet injection are known that are to ensure a high degree of homogenization of the initial fuel distribution and/or a high penetration depth of the injected fuel (US 2004/0040311 A1).

A further feature of known combustors is the presence of so-called stabilizer elements that are used for stabilizing flames in the combustion chambers (see FIG. 2). Apart from streamline bodies, so-called bluff-body geometries are above all used most of the time. These may e.g. be configured as baffle plates or also as stabilizers arranged in V-shaped configuration (e.g. U.S. Pat. No. 4,445,339 and US 2005/0028526). Due to the placement of a baffle body in the flow, the flow velocity is reduced in the wake of the stabilizer. The flow is considerably accelerated on the rim of the baffle body, so that due to the high pressure gradient downstream of the baffle body, a detachment of the boundary layer is observed, accompanied by the formation of a recirculating vortex system in the wake of the baffle body. If there is a combustible mixture on the rim of the recirculation zone or if hot combustion products are already present in the surroundings of the baffle body, it will be more likely due to the penetration of an ignitable mixture or the hot combustion products into the recirculation zone that the flame velocity will approach the flow velocity.

The local fuel/air mixture is not adjustable in a controlled manner for the known combustor concepts. Especially in the case of the already mentioned film applicator concepts, the problem arises that although with a desired homogeneous axial and circumferential loading of the fuel on the film applicator an excellent air/fuel mixture can be achieved at combustion temperatures that are low on average, and thus low NOx emissions, the homogeneous mixture formation desired for high-load conditions may lead to a pronounced deterioration of the combustion chamber burn-out under partial load conditions due to an insufficient fuel loading on the film applicator (see FIG. 6). This is due to the reduced heat release associated with lean mixtures and the property regarding local flame extinction upon successive reduction of the fuel and at a low combustion-chamber pressure and temperature.

Likewise, drawbacks also arise with respect to flame anchoring by means of the known stabilizers. In general it is possible to set the recirculation magnitude in the wake of the stabilizer through the dimension of the flame holder, for instance the outer diameter and the resistance coefficient of the flow blockage. An application for a flame holder for a low-emission lean combustor is e.g. known from U.S. Pat. No. 6,272,840 B1. A drawback of such an application is however that with the help of the selected geometry of the flame stabilizer, only a specific flow form can be set and the shear layer between the accelerated and the decelerated flow is distinguished by very high turbulence. It is known with respect to such a flame stabilizer with V-shaped geometry that a high lean-extinction stability of the flame can be achieved through the formation of a strong flow acceleration ("jet") in the wake of a pilot combustor that is centrally arranged on the combustor axis. This is accomplished through a continuous reduction of the flow velocity of the pilot jet further downstream, the implementation of a recirculation in the wake of the flame stabilizer and the return of hot combustion gases upstream close to the stabilizer (see FIG. 3). However, it often happens that increased soot and nitrogen oxide emissions (NOx) arise from such flame stabilization. This form of flow can e.g. be accomplished through a small exit diameter A=A1 for the inner leg of the flame stabilizer.

Furthermore, reference is made to US 2002/0011064 A1 as prior art.

Another form of flow is characterized by a so-called "unfolding" of the flow and the formation of a recirculation region on the combustor axis (see FIG. 4). This effect regarding an "unfolding" of the flow and the formation of a large backflow zone on the combustor axis can be accomplished through an increase in the exit diameter A=A2. Apart from a central recirculation, a weakened recirculation region is additionally provided in this variant of the flame stabilizer in the wake of the stabilizer. As a consequence of this arrangement, lower soot and NOx emissions are achieved, but the flame stability in comparison with lean extinction is reduced at the same time.

As can be seen from the described effects, only a specific form of flow can be set with the formerly known flame stabilizer geometries, said form, however, only contributing to the improvement of a few operating parameters, such as lean extinction stability, while a deterioration of other operating parameters, such as soot and NOx emissions, is observed at the same time.

It is the object of the present invention to provide a gas-turbine lean combustor of the aforementioned type which, while being of a simple design and avoiding the drawbacks of the prior art, shows low pollutant emissions, improved flame stability and high combustion chamber burn-out.

The invention shall now be described below with reference to embodiments, taken in conjunction with the drawings, wherein:

FIG. 1 (prior art), shows a combustor for an aircraft gas turbine (U.S. Pat. No. 6,543,235 B1);

FIG. 2 (prior art), shows an example of a conventionally formed flame stabilizer with V-shape geometry (U.S. Pat. No. 6,272,640 B1);

Figure 7:
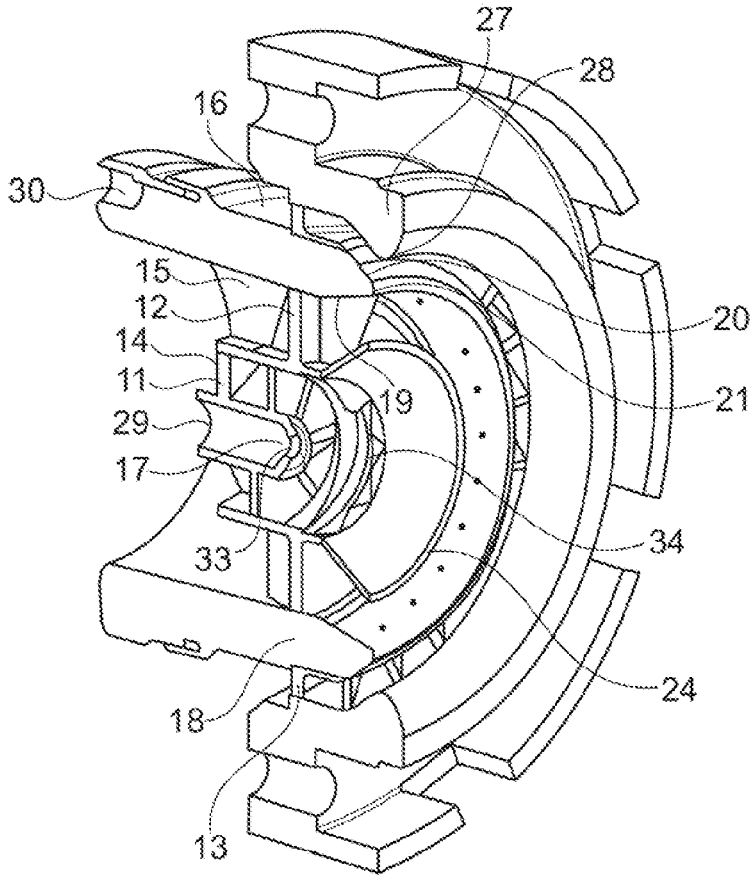
FIG. 7 shows a main components for the lean combustor according to the invention, variant with discrete fuel input of the main fuel through individual bores on the inner surface of the main fuel injection and with blossom-like geometry for the inner leg of the flame stabilizer.

The present invention provides for a combustor operated with air excess (see FIG. 7), which comprises a pilot fuel injection 17 and a main fuel injection 18. Within the main stage, the setting of a selective inhomogeneity of the fuel/air mixture is desired. It is the aim to achieve a load-dependent variation of the fuel placement in the main stage of the suggested lean combustor so as to influence the degree of the local fuel/air mixture. The background is that a high mixture homogenization on the one hand promotes the formation of low NOx emissions and that on the other hand a reduced mixture homogenization through the selective formation of locally rich mixture zones is of advantage to the achievement of a large burn-out of the combustion chamber particularly under partial load conditions. The partly competing properties shall be optimized through the method of load-dependent fuel inhomogeneity. Furthermore, the combustor is characterized by a novel flame stabilizer between the inner and central flow channel which, apart from the method for local load-dependent fuel enrichment, is to accomplish improved flow guidance inside the combustion chamber, particularly with respect to the interaction of the pilot and main flow.

Figure 20:
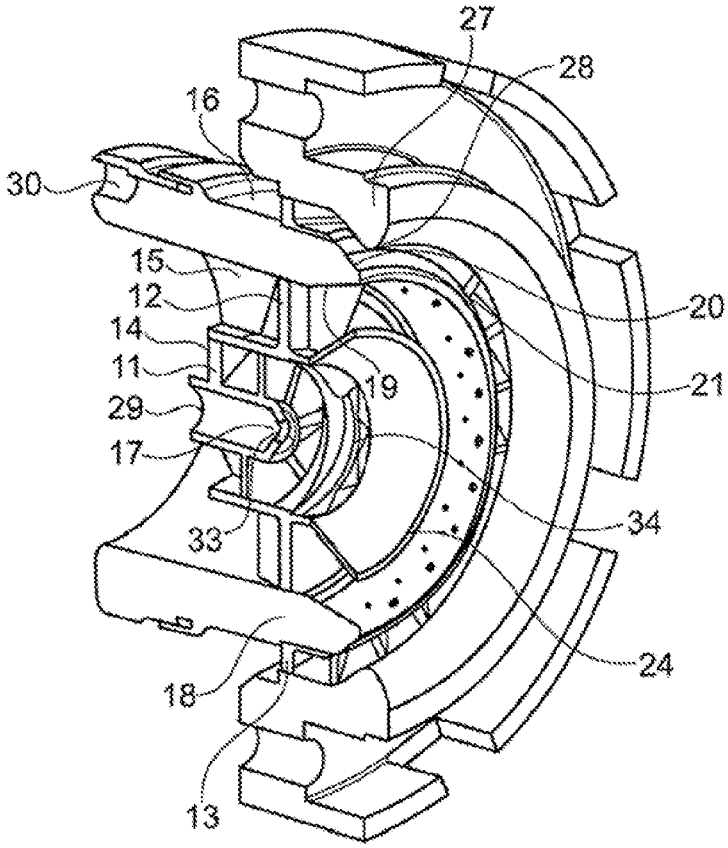
FIG. 20 shows a variant of the combustor of FIG. 7.

Controlled fuel inhomogeneity through discrete jet injection:

A discrete jet injection via a plurality of fuel bores n for the main stage of a lean combustor is suggested as the preferred method for setting local fuel inhomogeneities. Bores between n=8 and n=40 are preferably provided. The bores may here be distributed evenly or unevenly over the circumference. Furthermore, a single-row and a multi-row arrangement of the bores as well as a staggered arrangement are possible (see FIGS. 7 and 20). A controlled adjustment of the penetration depth of the discrete fuel jets and thus of the quality of the local fuel/air mixture can be achieved through appropriate constructional measures. The greatest pressure drop in the main fuel line and thus the cross section defining the metered delivery of the fuel is found on or near the inner surface 19 of the main stage 18. The discrete injection of fuel via bores takes place at a specific angle relative to the combustor axis radially inwards into the central flow channel 15. The fuel of the main stage may here be injected both on the upstream surface 38 and on the downstream surface 19 of the main fuel injection 18. The suggested method of discrete jet injection for the main stage of a lean combustor is distinguished by a load-dependent penetration depth of the discrete jets. Under low to average operating conditions in which the main stage is activated in addition to the pilot stage for ensuring reduced NOx and soot emissions, the penetration depth of the discrete fuel jets is small due to the reduced fuel pressure and thus due to a low fuel/air pulse ratio. Under higher load conditions the fuel/air pulse ratio significantly increases, resulting in a deeper penetration of the fuel jets into the central flow channel.

Figure 10:
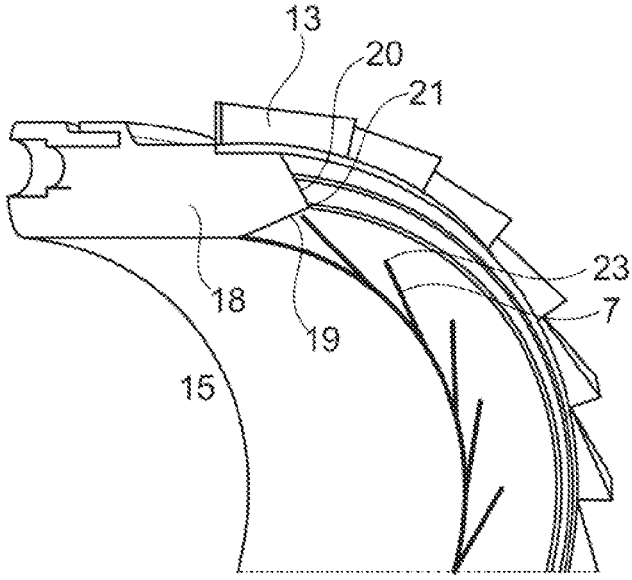
FIG. 10 shows a main stage of the combustor according to the invention; illustration of the calculated jet penetration into the central flow channel.
Figure 11:
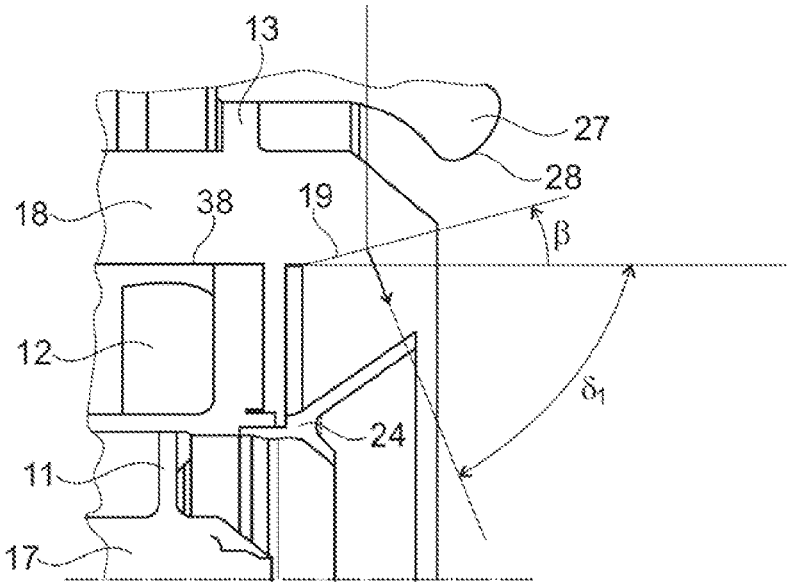
FIG. 11 shows a variant of the combustor according to the invention with illustration of the inclination of the fuel bores in axial direction δ1 and inclination of the inner downstream surface of the main fuel injection β.
Figure 12:
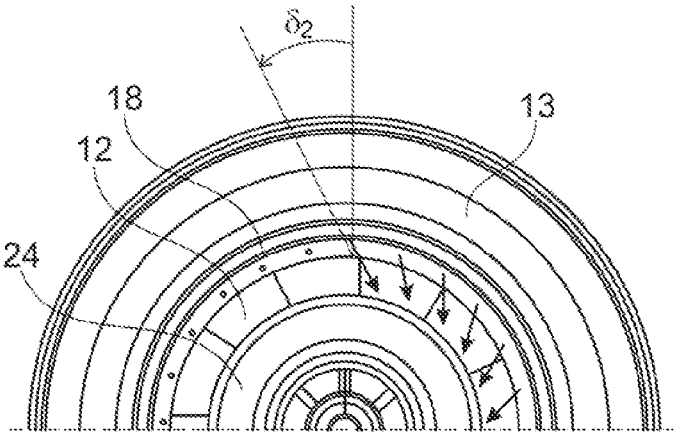
FIG. 12 shows a variant of the combustor according to the invention with illustration of the inclination of the fuel bores in circumferential direction δ2.

An essential feature of the present invention is that the exit openings of the discrete fuel injections are inclined in circumferential direction (see FIGS. 10, 12). The angle of inclination of the fuel jets in circumferential direction is to be within the range between 10°<δ2<60°. This can be accomplished through an orientation that in relation to the swirled air flow of the central air channel 15 is in the same or opposite direction. In general, the fuel jets may be inclined δ2 at individual angles. Since the fuel jets have been inclined circumferentially, a distinct reduction of the penetration depth of the jets is achieved in comparison with an unswirled injection at δ2=0°, which at a given number of injection points leads on the one hand to a homogenization of the fuel/air mixture on the circumference and on the other hand to a radial limitation of the fuel placement in the vicinity of the inner surface of the main fuel injection. The fuel jets may be further inclined relative to the combustor axis 4 in an axial direction. The preferred axial angle of inclination of the fuel jets is in the range between $-10° < \delta 1 < 90°$ (FIG. 11). Like with the circumferential inclination, the fuel jets may be inclined at individual angles δ1. Likewise, the bores may also be inclined individually (both with respect to δ1 and δ2).

Under low to mean load conditions, the described effects lead above all to an improvement of the combustion chamber burn-out due to local fuel enrichment. Under higher load conditions up to full load conditions a larger penetration depth of the jets is accomplished due to an increased fuel pressure and thus also increased fuel velocity of the individual jets. The associated intensification of the jet dispersion leads at a given circumferential inclination of the fuel jets to a further homogenization of the fuel/air mixture in radial direction and in circumferential direction. With this method of a strong inclination of the fuel jets δ1, δ2 it is possible to set lean fuel/air ratios under high-load conditions.

Figure 8:
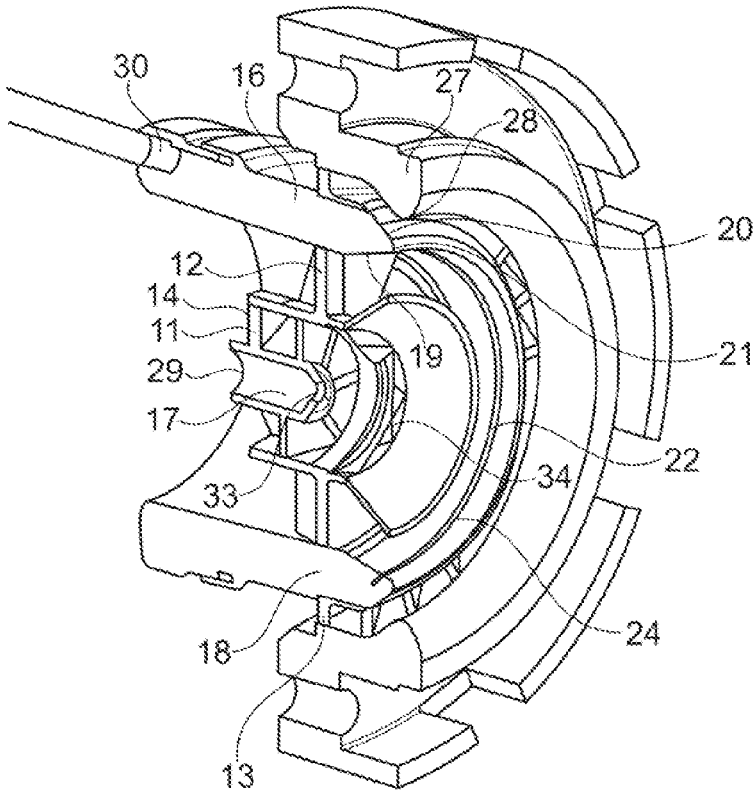
FIG. 8 shows a main components for the lean combustor according to the invention, variant with discrete fuel input of the main fuel via a film gap on the inner surface of the main fuel injection and with blossom-like geometry for the inner leg of the flame stabilizer.
Figure 9:
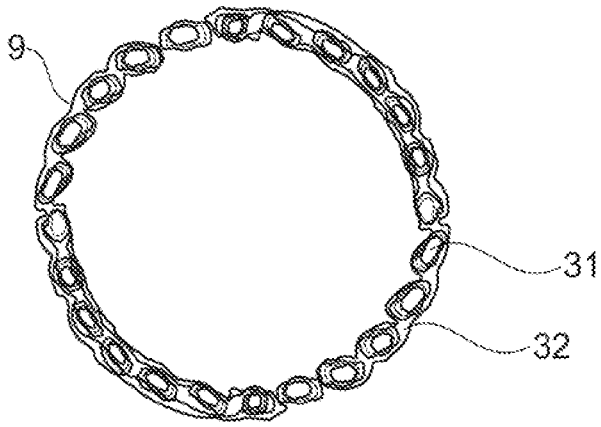
FIG. 9 shows a calculated circumferential distribution of the fuel/air distribution in the wake of the main fuel injection of the combustor: embodiment with specific inhomogeneity of the fuel input through inclined discrete fuel bores (example, n=24)
Figure 13:
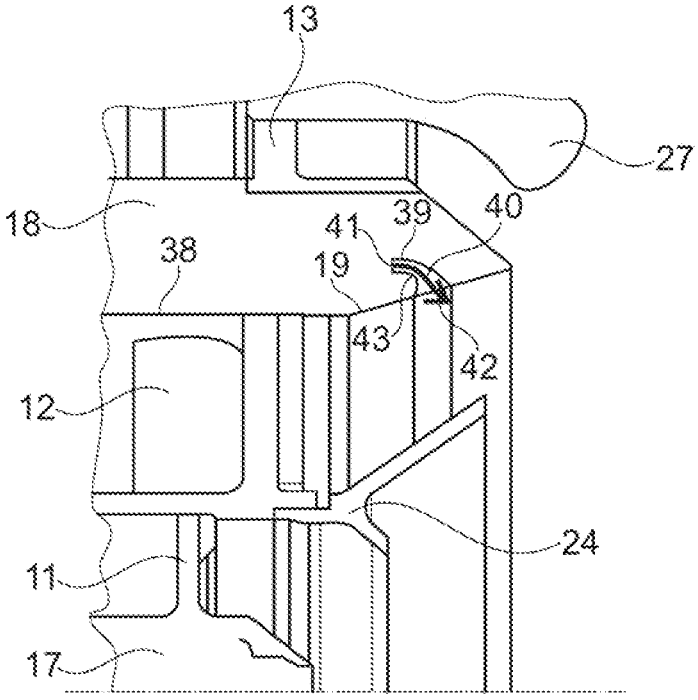
FIG. 13 shows a variant of the combustor according to the invention with film-like placement of the main fuel with local fuel enrichments, schematic illustration of the upstream metering of the main fuel via individual bores.

Controlled fuel inhomogeneity through a fuel film with local fuel enrichments:

FIG. 9 is a cross-sectional illustration showing a calculated circumferential distribution of the fuel/air mixture for the application of strongly inclined fuel jets for the main stage. Locally lean mixtures 32 can be seen and locally fuel-enriched zones 31 in the area of the jet penetration into the central flow channel. Apart from the metered delivery of the fuel via bores on or near the upstream and downstream surfaces 38, 19 of the main fuel injection 18, another feature of the present invention uses metered delivery of the fuel for the main stage further upstream in the fuel passage. A fuel placement via a film gap in the exit of the fuel passage, which fuel placement is changed in comparison with the discrete fuel injection for the main stage, is illustrated in FIG. 8. The main fuel is first metered upstream of the exit surface of the fuel passage via discrete fuel bores 41 (see FIG. 13). Both the number of the bores n and the circumferential inclination of the bores δ2 correspond to the already described parameter ranges in the event of the integration of the fuel bores on or near the inner surfaces 19 and 38 of the main fuel injection 18. Part of the fuel pulse is already decomposed prior to injection into the central flow channel 15 through suitable flow guidance by way of an inner and outer wall elements 43 and 40 of the fuel passage 39. It is the aim to form a fuel film with fuel inhomogeneities that can be adjusted in a circumferentially controlled way (similar to the fuel/air distribution shown in FIG. 9).

This can be accomplished with the help of two different methods. The first method includes metering the main fuel through discrete fuel bores upstream of the exit surface of the fuel passage and the direct adjustment of a fuel/air mixture that is inhomogeneous in a circumferentially controlled manner. This can be accomplished by suitably selecting the number, arrangement and inclination of the fuel bores and by ensuring a small interaction of the injected fuel jets with the already described wall element within the fuel stage. Thus, the fuel jets injected into the central flow channel still possess a defined velocity pulse. While the fuel film for known film applicator concepts is almost without any fuel pulse, a penetration depth (though a reduced one) of a more or less continuous or closed fuel film and a fuel input approximated to a fuel film can be adjusted by virtue of the flow guidance, the short running length of the main fuel between the inner surfaces 19 and 38 of the main stage 18 and the position of the bores 41.

For metering the fuel via discrete bores, and upstream of an exit surface of a main fuel line, and for generating a fuel film with defined fuel streaks, additional wall elements are provided downstream of the film gap, e.g. turbulators/turbulators, lamellar geometries, etc., which generate fuel inhomogeneities in circumferential direction.

Figure 19:
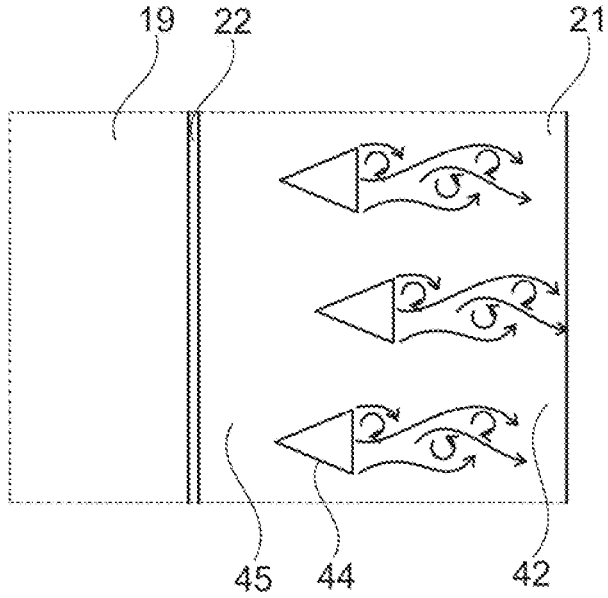
FIG. 19 shows a variant of the combustor according to the invention with film-like placement of the main fuel with local fuel enrichments by turbulators downstream of the film gap.

A "subsequent" local enrichment of the fuel film in circumferential direction is suggested as a further method for setting a circumferentially existing inhomogeneity of the fuel/air mixture in the use of a fuel film (FIG. 19). These inhomogeneities in the fuel distribution can be achieved by taking different measures, e.g. turbulators placed on the film applicator surface, a suitable design of the rear edge of the film applicator (e.g. undulated arrangement, lamellar form). The said methods for locally setting inhomogeneities for the fuel film can be performed inside the central flow channel upstream and/or downstream of the film gap.

Furthermore, it is preferably intended according to the invention to provide the arrangement of the turbulators on the surface of the film applicator as follows: upstream or downstream of the film gap, then each time in a single row or several rows, with/without circumferential inclination, but also a circumferentially closed ring geometry of the turbulator (e.g. a surrounding edge/stage).

Methods for increasing the air velocity in the central flow channel:

An essential feature of the suggested invention is also the intensification of the jet disintegration of the discrete individual jets or of the film disintegration of a fuel film that is inhomogeneous in a circumferentially controlled manner, for reducing the mean drop diameter of the generated fuel spray. This is to be accomplished 36 through the injection of the main fuel into flow regions of high flow velocity in the central air channel. The flame stabilizer 24, which is positioned between the pilot stage and the main stage, is provided 26 with an external deflection ring (leg) adapted to the geometry of the main stage. Said deflection ring is inclined relative to the combustor axis at a defined angle, the angle of inclination α ranging from 10° to 50°. A further measure for flow acceleration in the wake of the vanes for the central air channel is the provision of a defined angle of inclination for the inner wall 19 of the main stage 18. Said angle of inclination, based on the non-deflected main flow direction, is within the range between $5° < \beta < 40°$ (see FIG. 11). The described methods, inclination of the outer deflection ring and inclination of the inner wall of the main stage, lead to a distinct acceleration of the air flow in the central air channel in the wake of the vanes. The flow channel is configured such that the region of maximum flow velocities is located near the injection place of the main fuel.

Methods for avoiding flow interruption in the outer flow channel and for improving the fuel preparation of the main injection:

A further feature of the present invention is the suitable constructional design of the outer combustor ring 27. The inner contour of the ring geometry 28 is configured such that, in dependence upon the inclination of the outer wall of the main stage 20, the air flow in the outer air channel is not interrupted under any operating conditions (see FIG. 11). This is to ensure a flow with as little loss as possible without flow recirculation in the wake of the outer air swirler 13. Furthermore, the profiling of the inner contour of the ring geometry is chosen such that a high air proportion from the outer flow channel is provided for the fuel/air mixture of the main fuel injection.

Contoured Flame Stabilizer, Fixed Geometry:

To accomplish a decrease in pollutant emissions over a wide load range in addition to an improvement of the combustion chamber burn-out, it seems that the setting of a mixed and/or load-dependent flow shape with defined interaction of the pilot and main flame is advantageous. An excessive separation of the pilot flame and the main flame is to be avoided. It is generally expected that a strong separation of the two zones may lead to an improved operational behavior of the combustor when the pilot stage and main stage, respectively, is preferably operated. This is e.g. the case in the lower load range (only the pilot stage is supplied with fuel) and under high-load operation (a major portion of the fuel is distributed over the lean-operating main stage). However, this may reduce the combustion chamber burn-out over a wide portion of the operational range, particularly in the part-load range (e.g. cruising flight condition, staging point) because a complete burn-out of the fuel is critical for the main stage operating with a high air excess. That is why a controlled interaction of the two combustion zones is desired for accomplishing a temperature increase in the main reaction zone with the help of the hot combustion gases.

Figure 14:
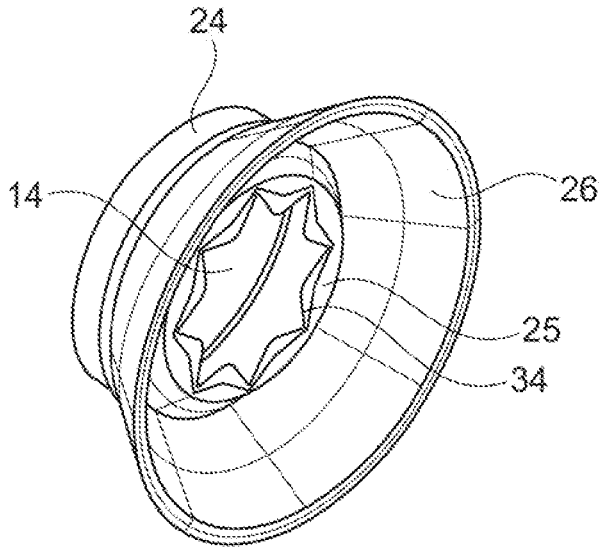
FIG. 14 shows an embodiment of a flame stabilizer with contouring of the exit geometry of the inner leg, blossom-like geometry.

According to the invention different geometries are provided for the flame stabilizers 24, which permit the defined setting of a flow field with pronounced properties of central and decentral recirculation. A specific contouring, both in axial and circumferential direction, of the flame stabilizer is generally suggested. One embodiment with a blossom-like geometry for the exit cross-section of a flame stabilizer is shown in FIG. 14. The diameter of the exit surface varies between a minimal diameter A1, which may lead to a pronounced decentral recirculation in the wake of the V-shaped flame stabilizer, and a maximum diameter A2, which may lead to the formation of a central recirculation on the combustor axis. It is expected, particularly because of the circumferential variation of the exit diameter A of the flame stabilizer, that both central and decentral recirculation can be set in a selective way.

Figure 1:
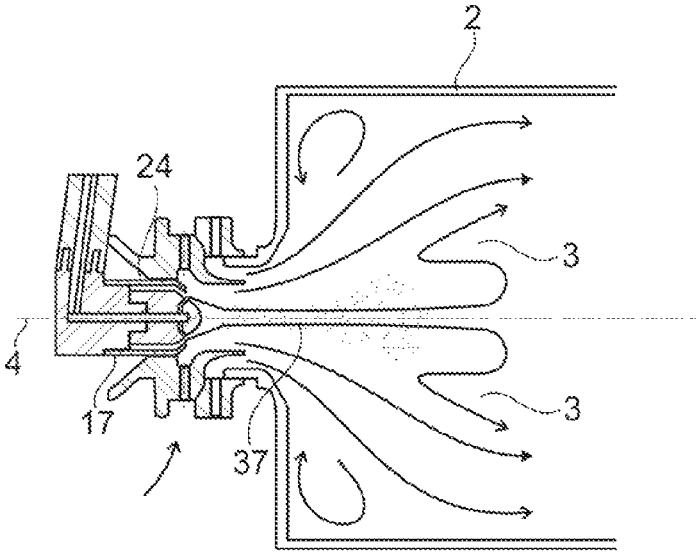
Fig. 1 (Prior Art)
Figure 2:
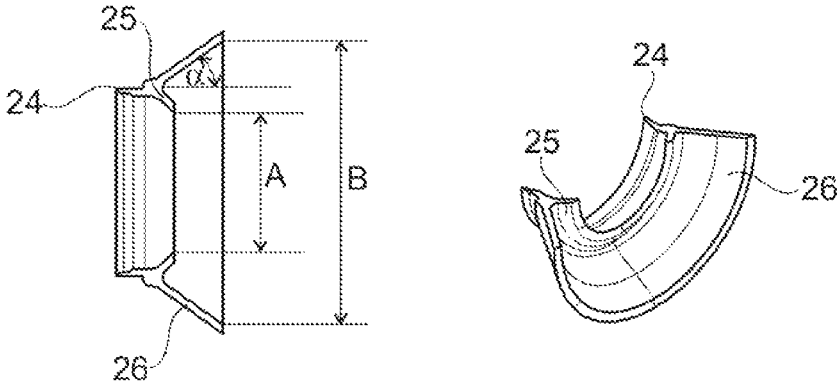
Fig. 2 (Prior Art)
Figure 3:
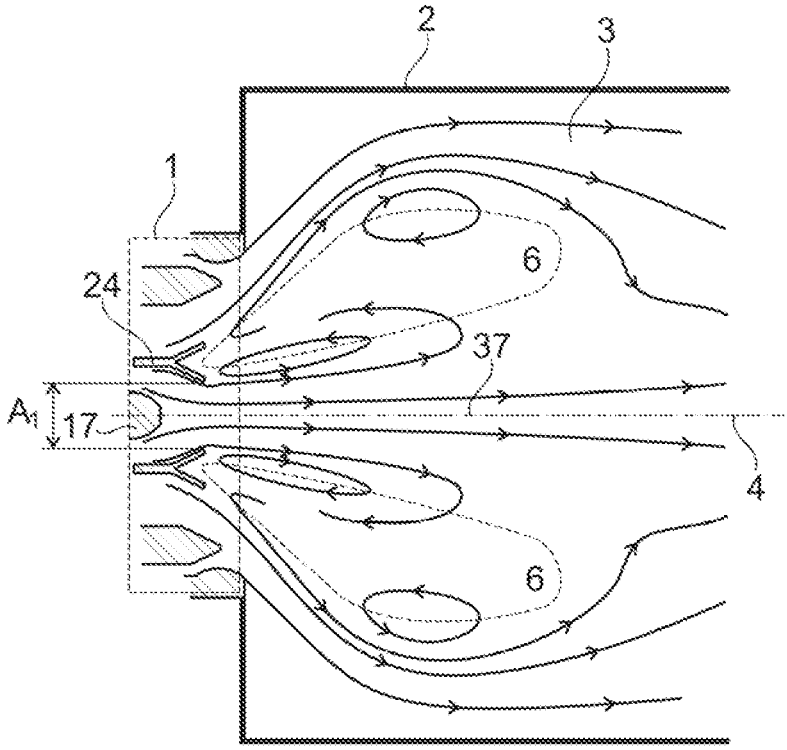
Fig. 3 (Prior Art)
FIG. 3 (prior art), shows a calculated flow shape in dependence upon the exit diameter of the inner leg of the flame stabilizer, example of a combustion chamber flow with pronounced decentral recirculation in the wake of the flame stabilizer due to a small exit diameter A=A1.
Figure 4:
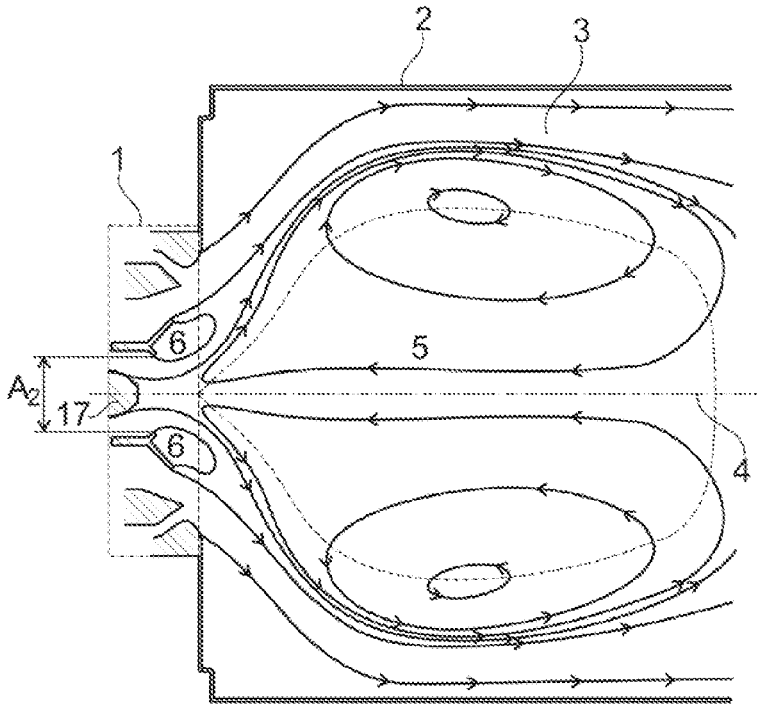
Fig. 4 (Prior Art)
FIG. 4 (prior art), shows a calculated flow shape in dependence upon the exit diameter of the inner leg of the flame stabilizer, example of a combustion chamber flow with central recirculation and significantly reduced recirculation region in the wake of the flame stabilizer due to an enlarged exit diameter A=A2.
Figure 5:
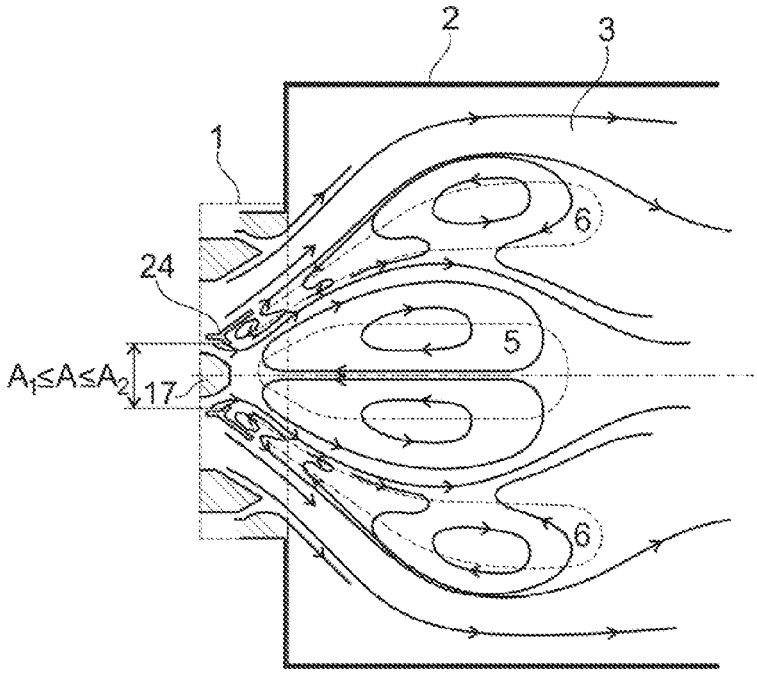
FIG. 5 shows a calculated "mixed" flow shape with central recirculation and pronounced decentral recirculation in the wake of a contoured flame stabilizer due to a circumferentially variable exit diameter of the flame stabilizer A1≤A≤A2.
Figure 6:
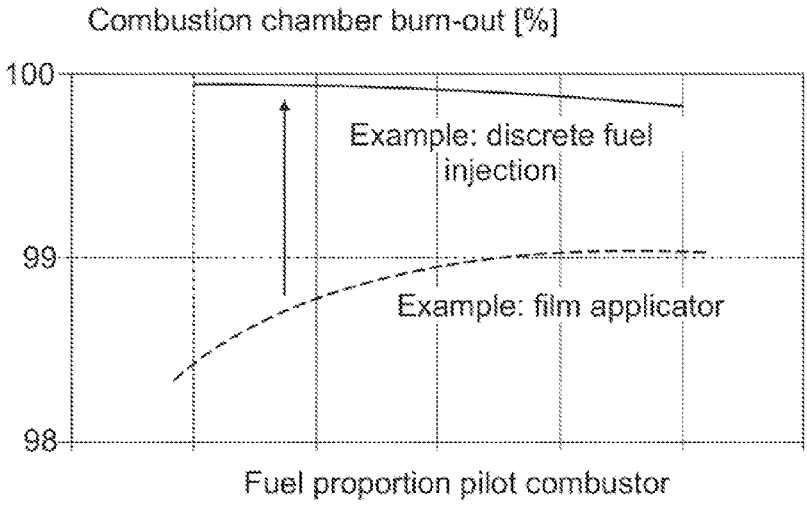
FIG. 6 shows a combustion chamber burn-out versus fuel proportion of the pilot combustor, schematic illustration of the burn-out behavior for a film applicator and for a discrete fuel jet injection for the main stage of the lean combustor under partial load conditions.
Figure 15:
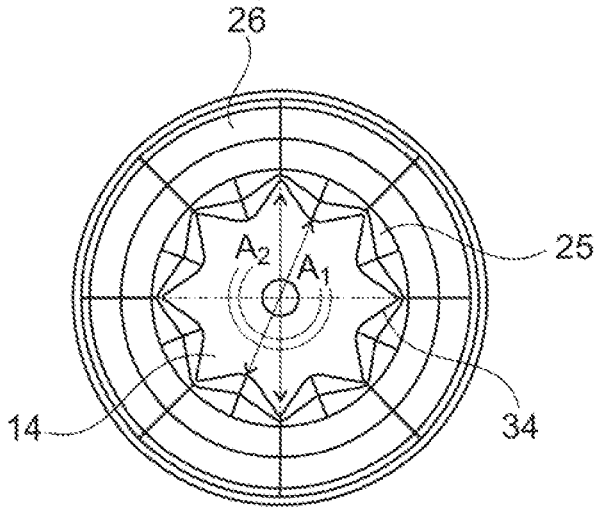
FIG. 15 shows a further embodiment of a flame stabilizer with stronger contouring of the exit geometry of the inner leg, blossom-like geometry.

Apart from the variant shown in FIG. 14 for a contoured flame stabilizer with eight so-called "blossoms", further variants are suggested, wherein the suggested geometries may comprise between 2 and 20 "blossoms". FIG. 15 shows a further embodiment for a slightly more strongly contoured flame stabilizer with eight "blossoms" where the diameter A1 has been reduced and the diameter A2 increased at the same time. This gives the flow a local flow acceleration or deceleration, respectively, which leads to a largely three-dimensional flow region with central as well as decentral recirculation (see FIG. 5).

A further embodiment is provided by the circumferential orientation of the 3D wave geometry (contourings) of the flame stabilizer on the effective swirl angle of the deflected air flow for the inner pilot stage and/or on the effective swirl angle of the deflected air flow for the radially outwardly arranged main stage.

Figure 16:
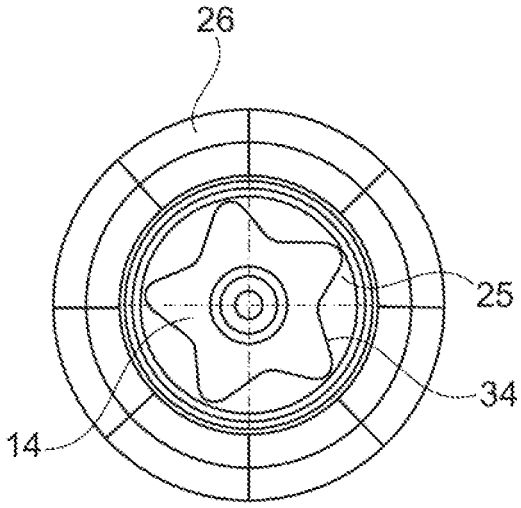
FIG. 16 shows a further embodiment of a flame stabilizer with contouring of the exit geometry of the inner leg, blossom-like geometry with opposite asymmetric variation of the exit diameter.
Figure 17:
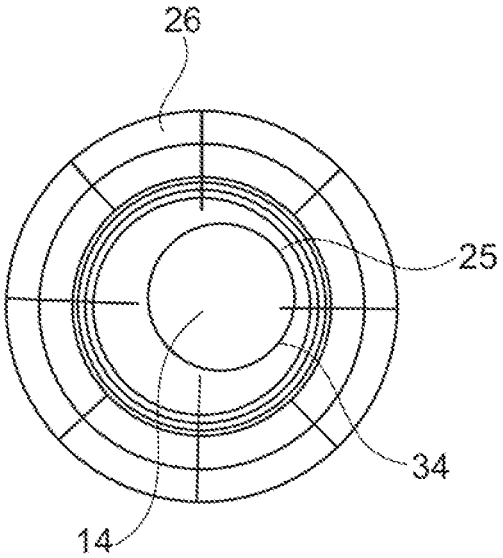
FIG. 17 shows a further embodiment of a flame stabilizer with contouring of the exit geometry of the inner leg, eccentric exit geometry.

FIG. 16 shows a further embodiment of the contoured flame stabilizer. The contouring of the inner leg of the flame holder comprises five blossoms, the number and arrangement of the blossoms accomplishing a diameter variation with controlled asymmetry in the flow guidance of the pilot flow. This realizes both a strong flow acceleration and, due to the cross-sectional enlargement, a deflection and flow deceleration in a sectional plane. As for the adjustable asymmetry in the pilot flow, FIG. 17 illustrates a further embodiment of a flame stabilizer with eccentric positioning. An additional possibility of the contouring of 25 is a sawtooth profile.

Figure 21:
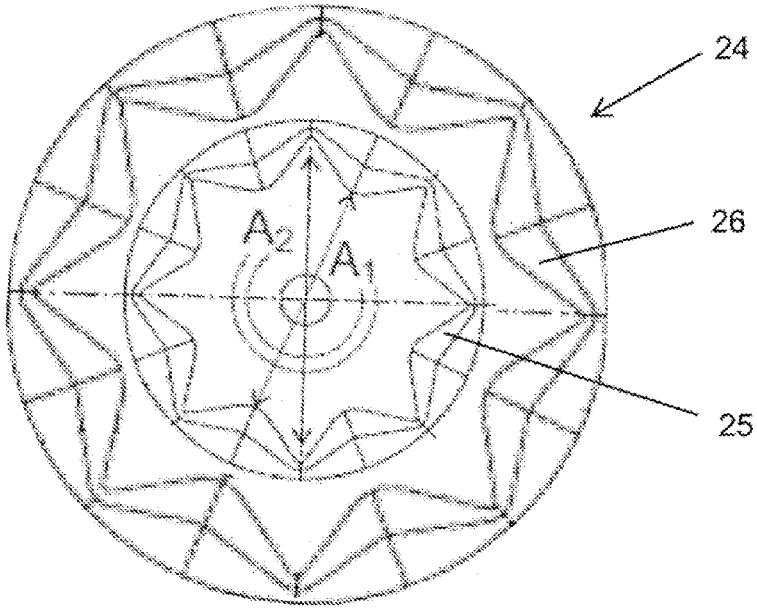
FIG. 21 shows a variant having a contoured outer leg.

Apart from the described contouring of the inner leg 25, a further feature of the present invention with respect to the configuration of the flame stabilizer is a contouring of the outer leg of the flame stabilizer 26, where the geometries suggested for the inner leg of the flame stabilizer can also be used for the outer leg 26. See FIG. 21.

Figure 18:
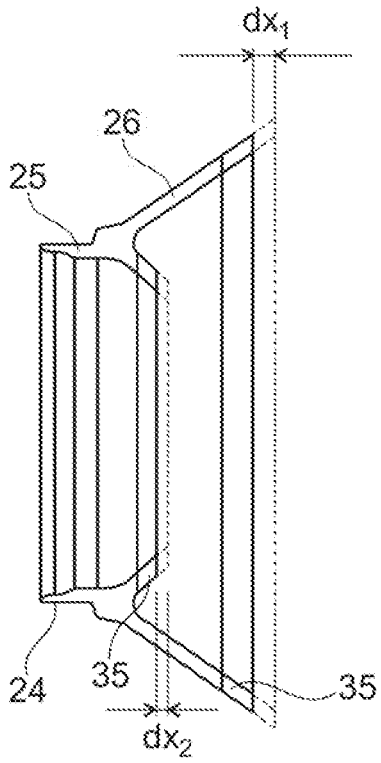
FIG. 18 shows an embodiment of a flame stabilizer with variable exit geometry, illustration of positioning possibilities of variable geometry elements (e.g. piezo or bi-metal elements) in the lower and upper leg of the flame stabilizer.

Contoured Flame Stabilizer, Variable Geometry:

For the controlled setting of a flow field with different backflow zones a variable geometry is suggested in addition to a geometrically fixed geometry of a contoured flame stabilizer. The advantage of a variable geometry is that in dependence upon the load condition a desired flow shape can be set in the combustion chamber and the operative behavior of the combustor can thus be influenced with respect to pollutant reduction, burn-out and flame stability. As a possibility of adapting the flow field with the help of a variable geometry for the flame stabilizer, the integration of piezo elements as intermediate elements or directly on the rear edge of the inner or outer leg of the flame stabilizer is for instance suggested. In the case of these elements the principle of the voltage-dependent field extension is to be exploited. This means that in the original state, i.e. without voltage load of the piezo elements, there is an enlarged exit cross-section of the flame stabilizer. This state corresponds to the presence of an enlarged exit diameter A2, which promotes the formation of a predominantly decentral recirculation zone. When a voltage state is applied, material extension takes place with a radial component in the direction of the combustor axis (see FIG. 18). This results in a small exit cross-section and, in combination with a reduced air swirl for the pilot stage, in the generation of a pronounced backflow region in the wake of the flame stabilizer. This leads, inter alia, to a distinct improvement of the flame stability with respect to extinction during lean operation of the combustor.

The implementation of bimetal elements in the geometry of the flame holder is suggested as a further principle of the variable setting of the flow shape through adaptation of the exit geometry of the flame stabilizer. The principle regarding the temperature-dependent material extension is here employed. Bimetal elements can for instance be integrated into the front part of the flame stabilizer or on the rear edge of the flame stabilizer so as to achieve a desired change in the exit geometry.

ADVANTAGES OF THE INVENTION

The essential advantage of the present invention is the controlled setting of the fuel/air mixture for the main stage of a lean-operated combustor. Due to the presence of locally rich mixtures a sufficiently high combustion chamber burn-out can be accomplished particularly under low to average load conditions with the described measures. Moreover, under high-load conditions a circumferentially improved fuel/air mixture can be achieved through the inclination of the fuel jets (particularly circumferentially), resulting in very low NOx emissions in a way similar to an optimized film applicator.

A further advantage of the invention is the possibility of a controlled setting of a "mixed" flow field with pronounced central and decentral recirculation regions. It is expected that the presence of a central recirculation helps to reduce NOx emissions significantly on the one hand and the adjustment of a sufficient backflow zone in the wake of the flame stabilizer helps to achieve a very high flame stability to lean extinction on the other hand. Furthermore, it is expected that the interaction between pilot and main flame can be set in a more controlled way because it is possible in dependence upon the 3D contour of the flame stabilizer to generate different flow states with a more or less strong interaction of the pilot and main flow. With the help of this selective generation of a "mixed" flow shape the operative range of the lean combustor can be significantly extended between low and full load.

A further advantage of the invention is expected with respect to the ignition of the pilot stage. Due to the contoured geometry of the exit surface with locally increased pitch diameters A2, a radial expansion (dispersion) of the pilot spray is generated, which may lead to an improved mixture preparation. This enhances the probability that a major amount of the pilot spray can be guided near the combustion chamber wall into the area of the spark plug, and the ignition properties of the combustor can thus be improved in dependence upon the local fuel/air mixture. A further advantage of the three-dimensional contouring of the flame stabilizer is a homogenization of the flow and thus reduced occurrence of possible flow instabilities, which may often form in the wake of baffle bodies, particularly in the shear layer.

An advantage of a variable adaptation of the exit cross-section of the flame stabilizer and thus in the final analysis the adjustment of the flow velocity resides in the possibility of "automatically" adjusting central or decentral recirculation zones inside the combustion chamber in dependence upon the current operative state. With the help of this method it would be possible to generate a central flow recirculation on the combustor axis within a specific operative range, the recirculation promoting the reduction of NOx emissions particularly in the high-load range due to the "unfolding" of the pilot flow and the corresponding interaction between the pilot flame and the main flame. On the other hand, a high flame stability can be reached in the lower load range by promoting a distinct increase in the flow velocity via a reduction of the exit surface of the flame stabilizer. This permits a defined optimization of the combustor behavior for different operative states.

LIST OF REFERENCE NUMERALS

1 fuel nozzle
2 combustion chamber
3 combustion chamber flow
4 combustor axis
5 central recirculation region
6 recirculation region in the wake of the flame stabilizer
7 fuel input for the main stage
8 fuel input for the pilot stage
9 fuel/air mixture of the main stage
10 fuel/air mixture of the pilot stage
11 inner air swirler
12 central air swirler
13 outer air swirler
14 inner flow channel
15 central flow channel
16 outer flow channel
17 pilot fuel injection
18 main fuel injection
19 inner downstream surface of the main fuel injection, film applicator
20 outer surface of the main fuel injection
21 rear edge of the main fuel injection
22 exit gap of the main fuel injection
23 exit bores of the main fuel injection
24 flame stabilizer
25 inner leg of the flame stabilizer
26 outer leg of the flame stabilizer
27 outer combustor ring (dome)
28 inner contour of the outer combustor ring
29 pilot fuel supply
30 main fuel supply
31 locally rich fuel/air mixture
32 locally lean fuel/air mixture
33 exit surface of the pilot fuel injection
34 exit contour of the inner leg of the flame stabilizer
35 bimetal elements
36 flow in the wake of the central swirler
37 accelerated velocity region on the combustor axis
38 inner upstream surface of the main fuel injection
39 fuel passage of the main fuel injection
40 outer wall element of the fuel passage of the main injection
41 alternative metering of the main fuel via upstream bores
42 fuel film with local fuel enrichment in axial and/or circumferential direction
43 inner wall element of the fuel passage of the main injection
44 turbulator element for generating local fuel inhomogeneities on the film applicator
45 fuel film with small fuel inhomogeneities in circumferential direction

What is claimed is:

1. A gas-turbine lean combustor comprising a combustion chamber and a fuel nozzle; the fuel nozzle comprising:

a centrally positioned pilot fuel injection;

a main fuel injection, wherein the main fuel injection comprises central bores for a controlled inhomogeneous fuel injection predominantly in a circumferential direction, a number of the bores on the circumference ranging from 8 to 40 and the bores having an angle of inclination $\delta_2$ in the circumferential direction of $10° \leq \delta_2 \leq 60°$ and an axial angle of inclination $\delta_1$ relative to a combustor axis of $-10° \leq \delta_1 \leq 90'$; and a V-shaped flame stabilizer comprising an inner leg which is contoured in an axial direction and in the circumferential direction and comprises 2 to 20 circumferentially arranged contours in blossom form wherein the V-shaped flame stabilizer circumferentially surrounds a central axis of the fuel nozzle and is positioned between the pilot fuel injection and the main fuel injection, the flame stabilizer further comprising an outer leg radially outwardly of the inner leg, the radially inner leg and the radially outer leg connected together at an upstream portion and extending away from one another toward a downstream portion to form said V-shape in cross-section, downstream ends of both the radially inner leg and the radially outer leg being positioned downstream of an exit of the pilot fuel injection.

2. The gas-turbine lean combustor according to claim 1, wherein the bores are disposed in a single-row arrangement.

3. The gas-turbine lean combustor according to claim 1, wherein the bores are disposed in a multi-row arrangement.

4. The gas-turbine lean combustor according to claim 1, wherein the bores are disposed in a staggered arrangement.

5. The gas-turbine lean combustor according to claim 1, and further including a plurality of further bores for metering the fuel positioned upstream of an exit surface of a main fuel line and for generating a fuel film with defined fuel streaks, a number of the further bores ranging from 8 to 40 and the further bores having an angle of inclination δ2 in circumferential direction of $10 \leq \delta 2 \leq 60°$.

6. The gas-turbine lean combustor according to claim 5, and further including turbulator elements positioned on a surface of the film applicator.

7. The gas-turbine lean combustor according to claim 6, wherein the turbulator elements are arranged upstream of a film gap.

8. The gas-turbine lean combustor according to claim 6, wherein the turbulator elements are arranged downstream of a film gap.

9. The gas-turbine lean combustor according to claim 1, for metering the fuel via discrete bores upstream of an exit surface of a main fuel line and for generating a fuel film with defined fuel streaks, the combustor further includes additional wall elements positioned downstream of the film gap for forming fuel inhomogeneities in a circumferential direction.

10. The gas-turbine lean combustor according to claim 1, wherein the contours of the blossom form are evenly distributed over the circumference.

11. The gas-turbine lean combustor according to claim 1, wherein the contours of the blossom form are unevenly distributed over the circumference.

12. The gas-turbine lean combustor according to claim 1, wherein the contours of the blossom form are distributed over the circumference with an eccentricity of an exit geometry relative to a combustor axis.

13. The gas-turbine lean combustor according to claim 1, wherein an outer leg of the V-shaped flame stabilizer is contoured in the axial direction and in the circumferential direction with 2 to 20 circumferentially arranged contours of a blossom form.

14. The gas-turbine lean combustor according to claim 13, wherein the contours of the blossom form are evenly distributed over the circumference.

15. The gas-turbine lean combustor according to claim 13, wherein the contours of the blossom form are unevenly distributed over the circumference.

16. The gas-turbine lean combustor according to claim 13, wherein the contours of the blossom form are distributed over the circumference with an eccentricity of the exit geometry relative to the combustor axis.

17. The gas-turbine lean combustor according to claim 1, wherein the V-shaped flame stabilizer has a variable geometry.

18. The gas-turbine lean combustor according to claim 1, wherein an inner wall of a main stage of the fuel injection is inclined to an angle $\beta$ between 5° and 60° relative to a combustor axis.

* * * * *